US005423242A

United States Patent [19]

Schuemann

[11] Patent Number: 5,423,242

[45] **Date of Patent: * Jun. 13, 1995**

[54] HYBRID PORTED FIREARM

[76] Inventor: Wilfred C. Schuemann, 705 Wagner Dr., Carson City, Nev. 89703

[ * ] Notice: The portion of the term of this patent subsequent to Jul. 24, 2007 has been disclaimed.

[21] Appl. No.: 901,795

[22] Filed: Jun. 22, 1992

Related U.S. Application Data

[63] Continuation-in-part of Ser. No. 522,387, May 11, 1990, Pat. No. 5,123,328, which is a continuation of Ser. No. 321,898, Mar. 10, 1989, Pat. No. 4,942,801.

[51] Int. Cl.[6] ..... F41A 21/28

[52] U.S. Cl. ..... 89/14.3

[58] Field of Search ..... 89/14.3, 163, 186, 195, 89/196, 194; 42/1.06

[56] References Cited

U.S. PATENT DOCUMENTS

| | | | |
|---|---|---|---|
| 4,322,999 | 4/1982 | Aston | 89/14.3 |
| 4,534,264 | 8/1985 | Tarnoff et al. | 89/14.3 |
| 4,545,285 | 10/1985 | McLain | 89/14.3 |
| 4,691,614 | 9/1987 | Leffel et al. | 89/14.3 |
| 4,942,801 | 7/1990 | Schuemann | 89/14.3 |

FOREIGN PATENT DOCUMENTS

| | | | |
|---|---|---|---|
| 2466 | of 1865 | United Kingdom | 89/14.3 |

*Primary Examiner*—Stephen M. Johnson
*Attorney, Agent, or Firm*—Cahill, Sutton & Thomas

[57] ABSTRACT

Thrust from a plurality of nozzles disposed between the chamber and nozzle of a gun provide a vertical component of force to counter muzzle jump and gun rise and a horizontal component of force to compensate for asymmetric support of the gun to increase the accuracy of subsequent shots and to reduce the time necessary to return the gun on target.

29 Claims, 6 Drawing Sheets

FIG. 22
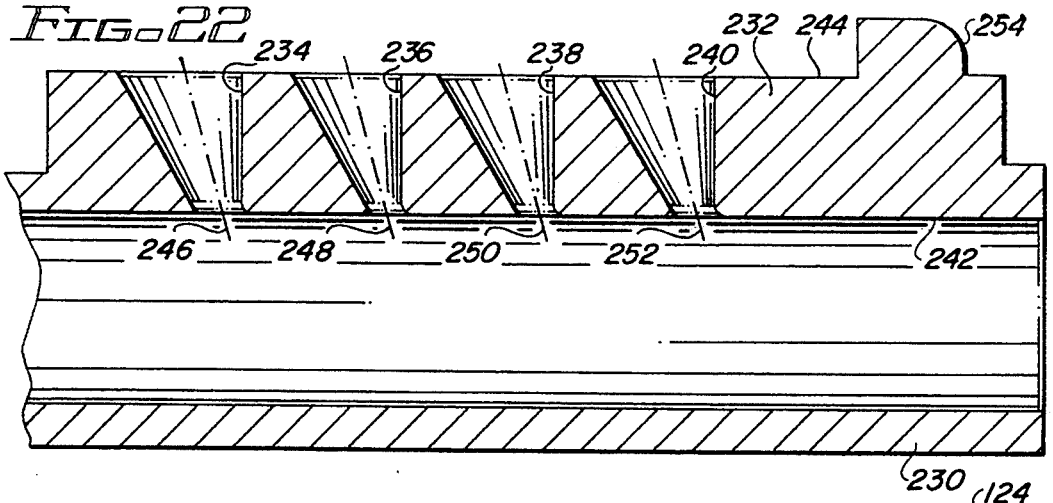
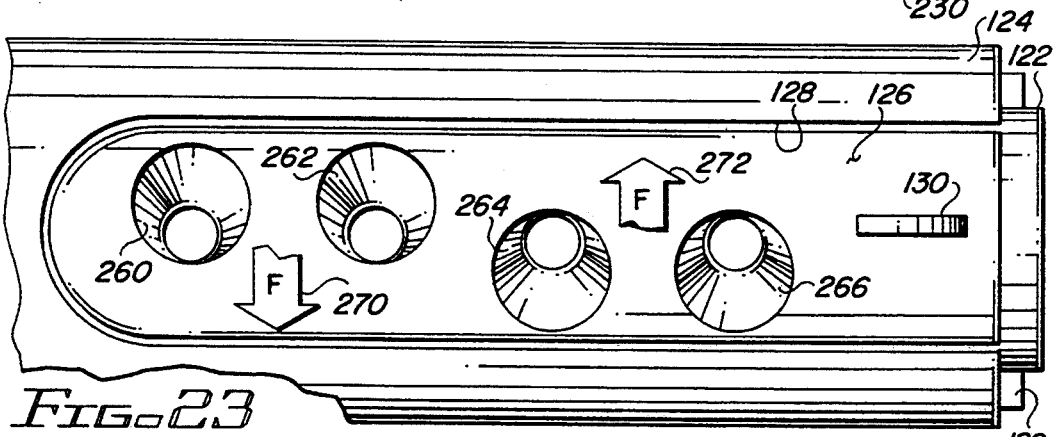
FIG. 23
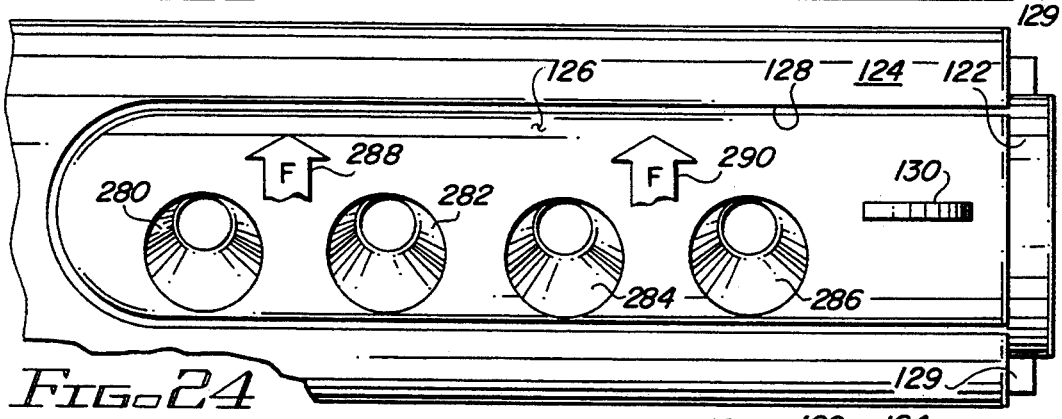
FIG. 24
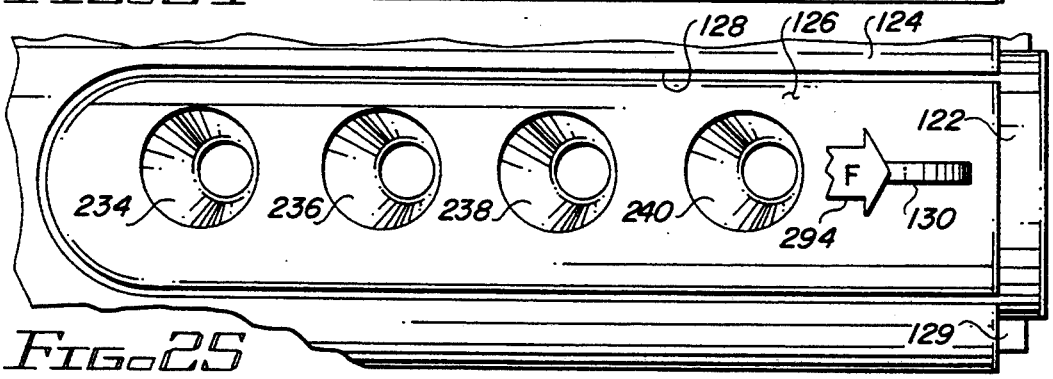
FIG. 25

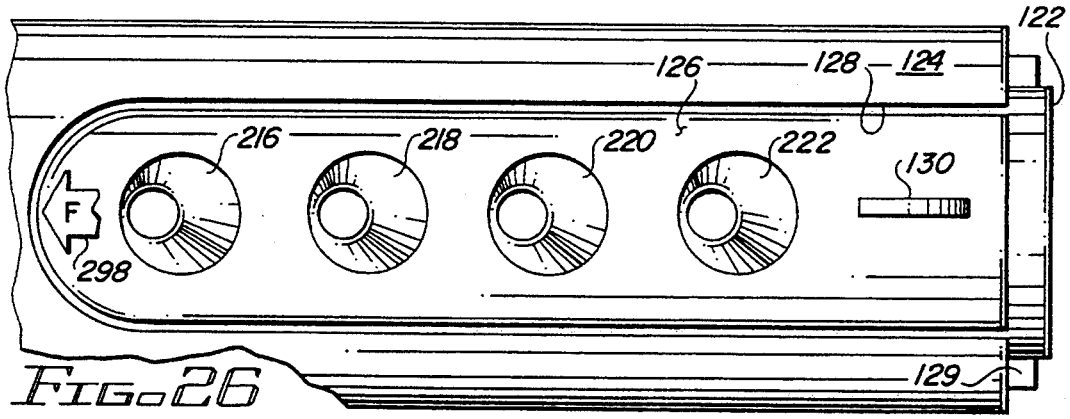
FIG. 26
FIG. 27
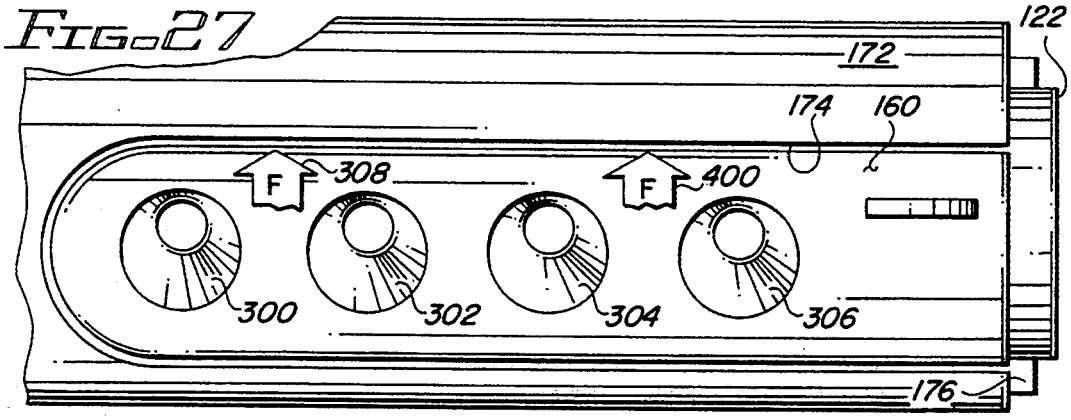
FIG. 28
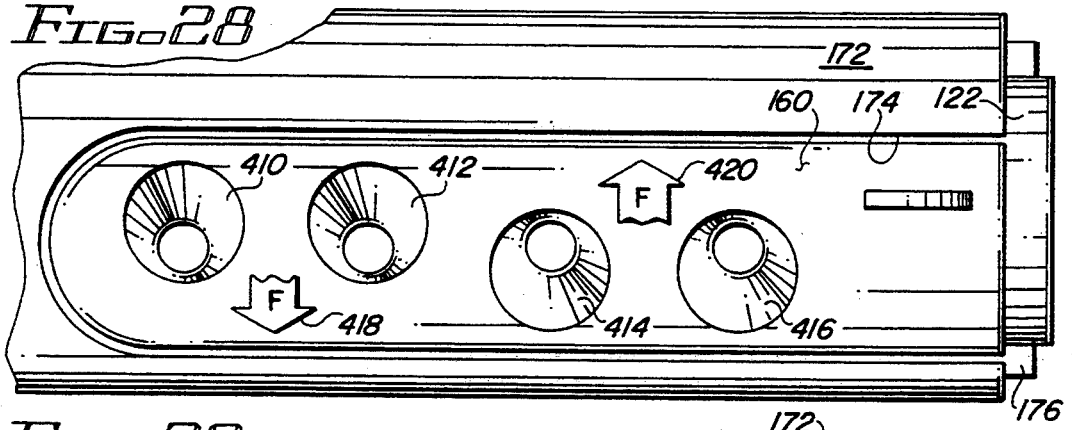
FIG. 29
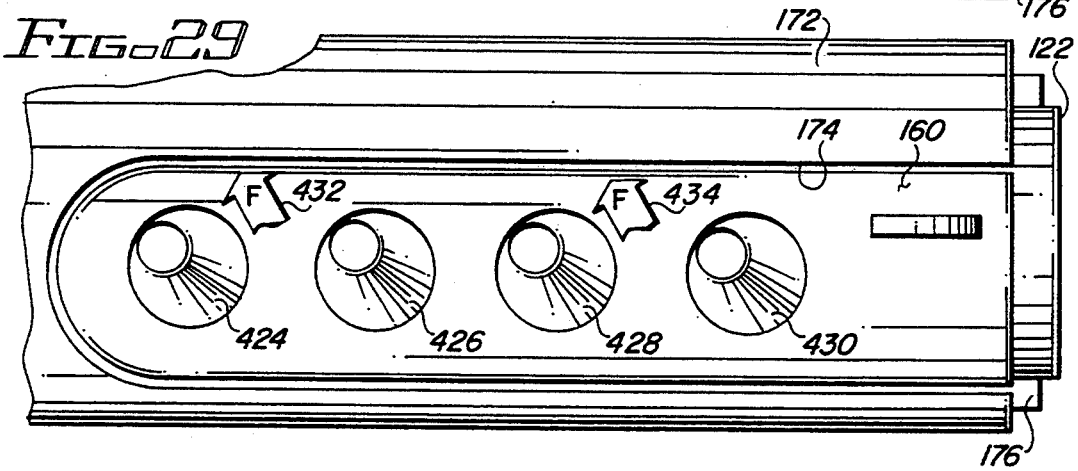

HYBRID PORTED FIREARM

CROSS REFERENCE TO RELATED APPLICATION

This application is a continuation in part application of a application entitled "FIREARM BARREL WITH NOZZLES", filed May 11, 1990, assigned Ser. No. 522,387, to be issued on Jun. 23, 1992 as U.S. Pat. No. 5,123,328, which is a continuation of an application entitled "FIREARM GUN RISE AND MUZZLE JUMP REDUCER", filed Mar. 10, 1989, Ser. No. 321,898, now U.S. Pat. No. 4,942,801, all of which describe an invention made by the present inventor.

BACKGROUND OF THE INVENTION

1. Field of the Invention

The present invention relates to porting of the propellant gas of a firearm and, more particularly, to the reduction of gun rise, muzzle jump and lateral motion of a firearm through porting of the propellant gas.

2. Description of Related Art

Handheld firearms, when fired, exhibit a phenomenon usually described as muzzle jump. The common intuitive understanding of the phenomenon has provided guidance for gunsmiths and inventors who have generated numerous devices intended to reduce the magnitude of the normal upward pivotal motion of the muzzle by venting the propellant gas upwardly at the muzzle to create a downward thrust on the muzzle. The ultimate purpose of these devices was and is that of permitting firing a series of shots more rapidly and accurately.

A better understanding of the phenomena which interfere with the rapid shooting of the firearm is required to more accurately address a solution. Central to this increased understanding is the concept that the phenomenon of gun rise is separate from the phenomenon of muzzle jump. Gun rise is an upward motion of the entire firearm when it is fired which would occur even if muzzle jump were completely eliminated. This concept of gun rise is not addressed in the known prior art.

Gun rise is a small upward motion of the firearm which interferes with the aiming of the firearm when several shots are fired from the firearm in quick succession. Gun rise motion occurs after the well known muzzle rise motion. Virtual elimination of gun rise permits the shooter to fire a series of shots rapidly and more accurately than is otherwise possible.

If only muzzle jump and gun rise were present when a handgun is fired, one would expect an experienced shooter to be capable of adapting his/her technique to bring the handgun back on target. Relatively little mental computation would be necessary and the assumed automatic return to the original shooting position would naturally improve the speed and accuracy of a subsequent shot. Unfortunately, the real situation differs considerably from the simplified assumption that only muzzle jump and gun rise are present and return of the handgun to its prefiring position is often not realized in practice. Several factors can produce muzzle motion which is angled laterally considerably from motion in a vertical plane. The subsequent path of the muzzle can be somewhat circular and it is difficult to accurately return the handgun to the original shooting position.

When shooting a semi automatic handgun, the combination of the positioning and holding power of the hands combined with the positioning of the wrist, as well as the elbow and shoulder, will normally produce muzzle motion which is not vertical. This is partly due to the effective point of support for the handgun being located to the side of the vertical plane of symmetry of the handgun. The resulting sideways component of muzzle motion changes the simple vertical one dimensional motion into a two dimensional motion which demands considerably more mental computation to track and compensate for the muzzle motion. Upon analysis it has been determined that the following causal factors are present: 1) the rotational stiffness, in the vertical plane of symmetry of the handgun and resulting from the shooter's hold of the handgun, is usually different from the rotational stiffness in the horizontal plane; 2) the rotational stiffness in the vertical plane and the horizontal plane are likely to be non linear; and 3) the errors and non linearities of the human response/reaction in the horizontal and vertical planes will produce a muzzle motion which is somewhat circular and which is not likely to return the muzzle to the original shooting position. The lateral movement of the handgun in combination with the vertical movement of the handgun increases the time required to return the handgun to the target for the following shot and tends to decrease the accuracy of the following shot(s).

The known prior art is directed to reduction or elimination of muzzle jump. Generally the muzzle jump is sought to be countered by the installation of ports directly into the barrel near the muzzle to vent the propellant gas directly into the atmosphere. Numerous variants of such vents exist for rifles and non semiautomatic handguns. Radial (upward, lateral and/or downward) porting of propellant gas from the barrel near the muzzle through simple ports allegedly reduces muzzle jump or allegedly reduces recoil by reducing the propellant gas pressure in the barrel before the projectile leaves the muzzle. Upward porting of the barrel near the muzzle with side by side paired ports with each port of each pair being equally spaced from a vertical plane coincident with the axis of the barrel is a well known variant which allegedly helps reduce muzzle jump. In some embodiments, the propellant gas may be vented radially (laterally) in opposing directions, without upward venting at the muzzle. Another approach includes using radial (lateral) ports disposed in the barrel between the chamber and muzzle to vent the propellant gas posteriorly on each side to help reduce recoil. Finally, it is known to use radially oriented, backward facing and diverging paired ports spaced from near the chamber to near the muzzle to symmetrically vent the propellant gas simultaneously in different directions to generate equal opposing forces.

SUMMARY OF THE INVENTION

A group of nozzles vent the propellant gas upwardly and laterally from within the barrel. The group of ports may be placed in the generally upper part of the barrel or in a rib on the upper part of the barrel. The fore and aft center of the group of ports may be located approximately at a point midway between the chamber and muzzle of the firearm. Such placement of the group of ports produces a substantial downward thrust in combination with lateral thrust or formation of a couple to counter lateral movement of the barrel. The downward thrust produced is located close to the center of mass of the firearm with the principal effect being that of urging the firearm downwardly to virtually eliminate the motion of gun rise. Secondarily, because the location of the downward thrust is somewhat forward of the center of mass of the firearm, the muzzle jump of the firearm is reduced. Thirdly, the lateral thrust or couple will reduce or eliminate lateral displacement and angular movement of the muzzle.

It is therefore a primary object of the present invention to provide ports in a handheld firearm to substantially reduce both the vertical and lateral motions of the firearm when it is fired.

Another object of the present invention to improve upon the reduction of gun rise and muzzle jump as a secondary benefit of countering lateral displacement and angular movement of a firearm.

Yet another object of the present invention to provide nozzles in the barrel of a firearm to produce a couple to counter lateral angular movement of a handgun when it is fired.

Still another object of the present invention to provide nozzles in the barrel of a firearm to produce a horizontal component of thrust to compensate for an asymmetric handgrip of a handgun when it is fired.

A further object of the present invention is to provide a group of nozzles in the barrel of a hand held firearm that compensate for gun rise, muzzle jump and asymmetric hand and arm support relative to the firearm when it is fired.

A yet further object of the present invention is to provide a group of nozzles in the barrel of a semi automatic handgun to assist a shooter in returning the handgun on target after each shot.

A still further object of the present invention is to provide a method for reducing excursion of a handgun in botch the vertical and horizontal planes when it is fired.

These and other objects of the present invention will become apparent to those skilled in the art as the description of the present invention proceeds.

BRIEF DESCRIPTION OF THE DRAWINGS

The present invention will be described with greater specificity and clarity with reference to the following drawings, in which:

FIG. 22 is a partial cross sectional view illustrating rearwardly angled ports in the rib of a barrel;

FIG. 23 is a top view taken along lines 23—23, as shown in FIG. 17;

FIG. 24 is a partial top view illustrating laterally angled ports in the rib of a barrel;

FIG. 25 is a top view illustrating rearwardly angled ports in the rib of a barrel;

FIG. 26 is a top view illustrating forwardly angled ports in the rib of a barrel;

FIG. 27 is top view illustrating a canted rib of a barrel having laterally angled ports;

FIG. 28 is top view of a canted rib of a barrel having oppositely angled ports; and FIG. 29 is a top view of a canted rib of a barrel having laterally and forwardly angled ports.

DESCRIPTION OF THE PREFERRED EMBODIMENT

Figure 1:
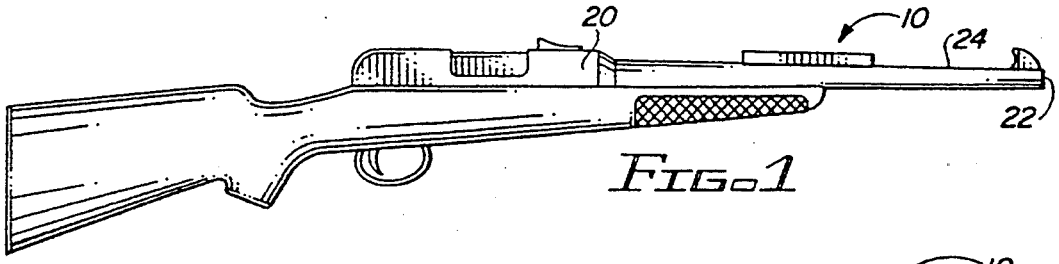
FIG. 1 illustrates a ported rifle or a shotgun.

This invention described herein applies equally well to all types of firearms, such as rifles, shotguns, submachine guns, handguns, and particularly to semi automatic pistols. The principles inherent in the present invention will be described using primarily a semi automatic handgun as an example.

An understanding of the phenomenon heretofore called muzzle jump renders it evident that the motion of a handgun, and to a lesser extent other firearms, when fired consists of a sequence of three motions. The first motion is a very rapid upward rotation of the handgun pivoting about a point located somewhere between the center of gun/hand mass and the wrist. This is the motion which is clearly apparent to the eye when the handgun is fired and is widely referred to as muzzle jump. The second motion occurs after the first motion and consists of a relatively smaller, slower, less obvious upward motion of the handgun,as the handgun, hand and arm rotate upwardly about a pivot point at the shoulder of the person firing the handgun. During this second motion, the upper portion of the firearm blocks the shooter's view of the target and the aiming process cannot resume until the motion ends and the handgun is returned to the prefiring position. This motion may be accurately referred to as gun rise.

The vertical motion of a handgun due to muzzle jump and gun rise and compensatory vertical motion by a shooter to the prefiring position is often not realized in practice due to lateral displacement and/or lateral angulation of the handgun. Several factors produce motion of the muzzle which is angled or displaced considerably laterally from a controllable vertical direction. The subsequent path of the muzzle may be somewhat circular and usually will not result in an immediate return to the prefiring position. When shooting a handgun, such as a semi automatic handgun, the combination of the positioning and holding power of the hand(s) and the position of the wrist, as well as the elbow and shoulder, will normally not produce muzzle motion only in the vertical plane because the effective point of support for the handgun is located to the side of the vertical plane of symmetry of the handgun. The resulting lateral component of muzzle motion changes the simple vertical one dimensional motion into a two dimensional motion that demands considerably more mental computation to track and compensate for the muzzle motion. After much experimentation and analysis it has been determined that a lateral component of motion exists because: 1) the rotational stiffness in the vertical plane of symmetry of the handgun resulting from the hold of the handgun is usually different from the rotational stiffness in the horizontal plane; 2) rotational stiffness in the horizontal and vertical planes will likely be non linear; and 3) the inherent errors and non linearity of the human response in these two planes will produce a muzzle motion which is somewhat circular and which will not return the muzzle to the original position. The resulting effect is an increase in time to fire a following shot accurately and there is a tendency to decrease the accuracy of the subsequent shot.

The ability of the shooter to fire the gun rapidly and accurately is limited by the muzzle jump, the gun rise and the lateral motions because they interrupt the ability of the shooter to aim the firearm. All known prior art solutions have focused upon reducing the visually apparent muzzle jump. The second motion, that of the gun, hand and arm relatively slowly rotating upwardly about the shoulder and then returning to the prefiring position, has not been noted explicitly in the prior art and the popular press. The end of the gun rise motion, rather than the end of the muzzle jump motion, determines when the shooter can aim and fire the gun again because gun rise occurs after muzzle jump. The non linearities of support and compensatory movement in the horizontal plane has not at all been addressed in the literature. It is the purpose of this invention to substantially reduce both muzzle jump and gun rise but with more emphasis placed on compensation for reducing lateral motion. This will improve the ability of the shooter to shoot the firearm rapidly and accurately.

The amount of thrust which can be generated by porting the propellant gas at the muzzle of a firearm is small because the energy of the propellant gas has been substantially spent by the time the projectile or bullet reaches the muzzle. In addition, the modification to the forward end of the barrel or the installation of a device at the muzzle must accomplish its function in the time period between the base of the bullet passing into the area of the modification or device and exiting the muzzle to no longer obstruct passage of the propellant gas out the front of the barrel of the device. The time available for the modification or for the device to function is therefore very short and this short time period restricts the possible effectiveness of the modification or the device.

The present invention consists of a group of simple ports or diverging nozzles installed along the upper surface of the barrel and between the chamber and muzzle. Usually the first port of the group will be closer to the chamber than to the muzzle and the remainder of the group of ports will be spaced along the upper surface of the barrel between the first port of the group and the muzzle. This line or lines of ports produces a downward thrust on the firearm by upward venting of the propellant gas from the barrel.

Several advantages over the prior art muzzle oriented ports are achieved from such a group of ports: (1) there is more time available to vent the propellant gas from the barrel before the bullet leaves the muzzle since the venting begins sooner; (2) the earlier venting permits the venting of virtually all the propellant gas in the barrel through the group of simple ports or diverging nozzles to maximize the generation of the thrust desired; (3) because more time is available, more efficient conversion of the gas energy into thrust is possible; (4) the gas will be at a higher pressure nearer the chamber when the venting begins and more energy is therefore stored in the gas to be converted into thrust closest to the chamber; (5) because the pressure in the barrel is reduced for a substantial distance along the barrel, it may be necessary to increase the propellant charge in order to maintain the original bullet or projectile velocity, thereby more gas at a higher pressure can be utilized to produce a substantial increase in the thrust available for reducing muzzle jump, gun rise and lateral motion. By using nozzles rather than simple ports, several advantages are obtained: (1) the nozzles are more efficient in converting gas energy into thrust; and (2) the duration of the discharging gases permits an improved thrust coefficient of the nozzles.

Figure 2:
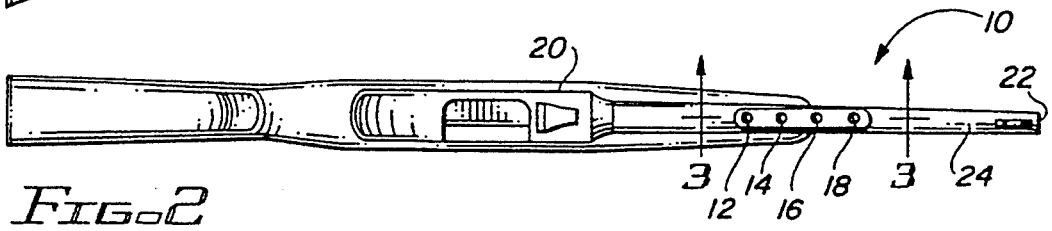
FIG. 2 is a top view of the rifle or shotgun shown in FIG. 1.
Figure 3:
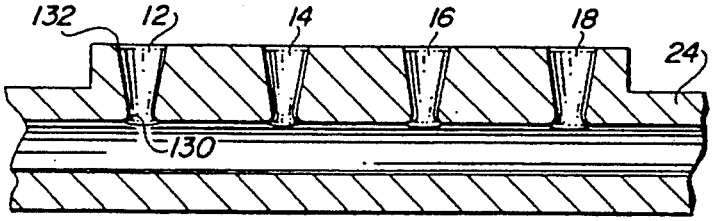
FIG. 3 is a partial cross sectional view taken along lines 3—3, as shown in FIG. 2.

The present invention can be incorporated into all firearms and particularly handheld firearms, as will be evident from the following overview of the invention with reference to the figures. FIGS. 1–3 illustrate a rifle 10 (or shotgun) incorporating a group of ports or nozzles (12,14,16 and 18). First port 12 of the group of ports is usually closer to chamber 20 than to muzzle 22 of the firearm and the remainder of the group of ports (14,16,18) is spaced along the top of barrel 24 between the first port and the muzzle.

Figure 4:
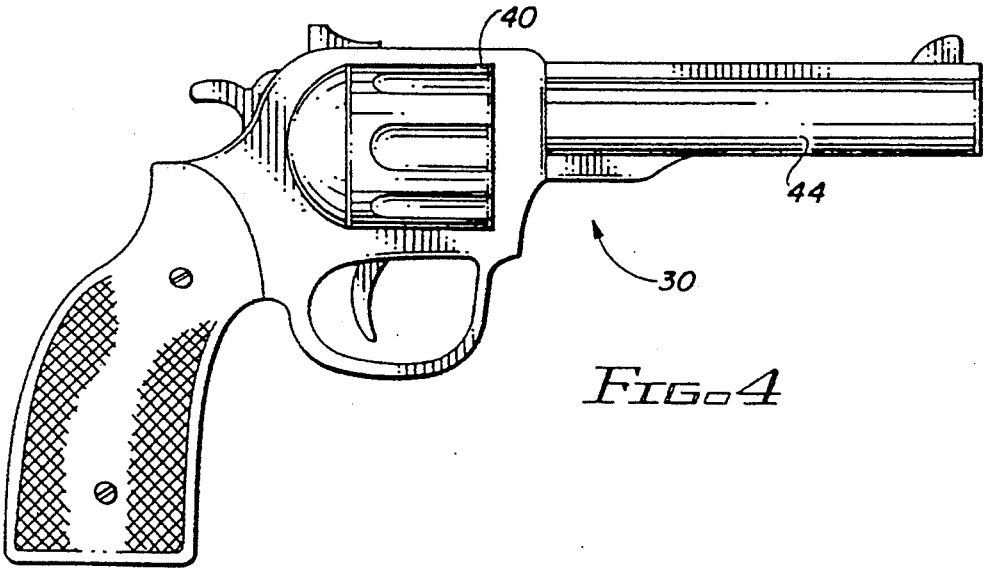
FIG. 4 illustrates a ported revolver.
Figure 5:
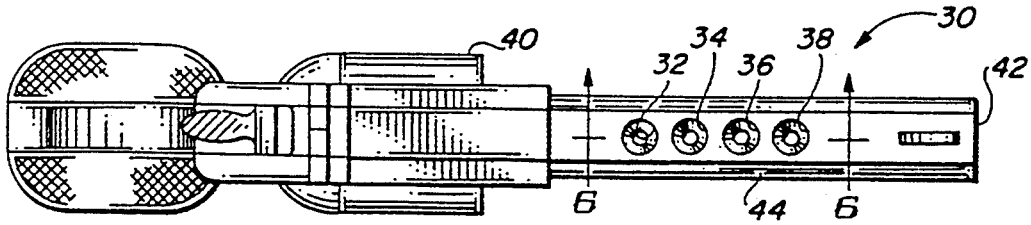
FIG. 5 is a top view of the revolver shown in FIG. 4.
Figure 6:
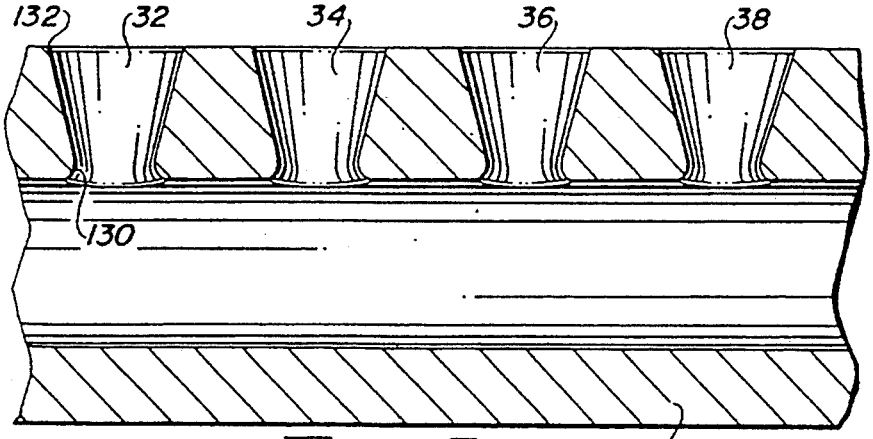
FIG. 6 is a partial cross sectional view taken along lines 6—6, as shown in FIG. 5.
Figure 7:
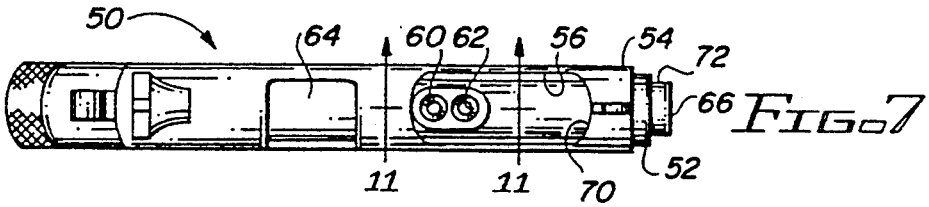
FIG. 7 is a top view of a ported semi automatic pistol.
Figure 8:
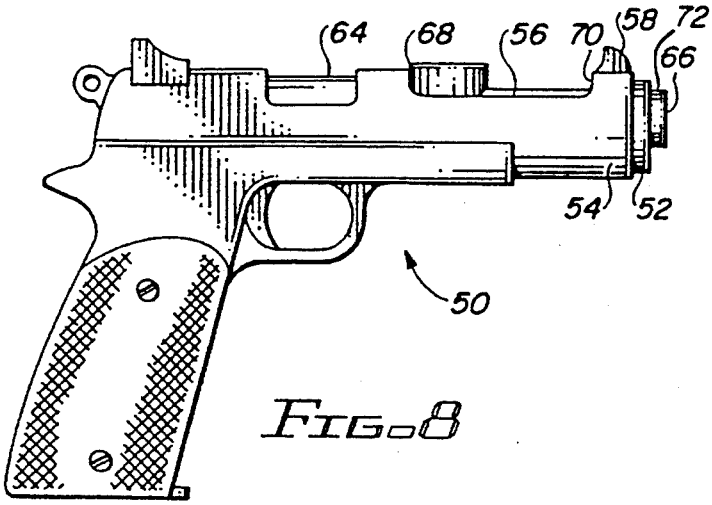
FIG. 8 is a side view of the pistol shown in FIG. 7.
Figure 9:
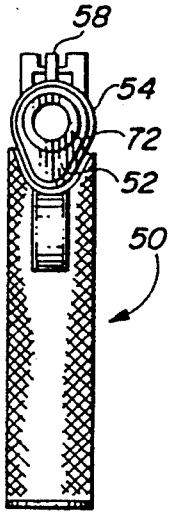
FIG. 9 is a front view of the pistol shown in FIG. 7.

FIGS. 4–6 illustrate a revolver 30 incorporated the present invention. First port 32 of the group of ports or nozzles (32,34,36 and 38) is usually closer to chamber 40 than to muzzle 42 of the firearm and the remainder of the group of ports (34,36 and 38) are spaced along the top of barrel 44 between the first port of the group of ports and the muzzle.

Figure 10:
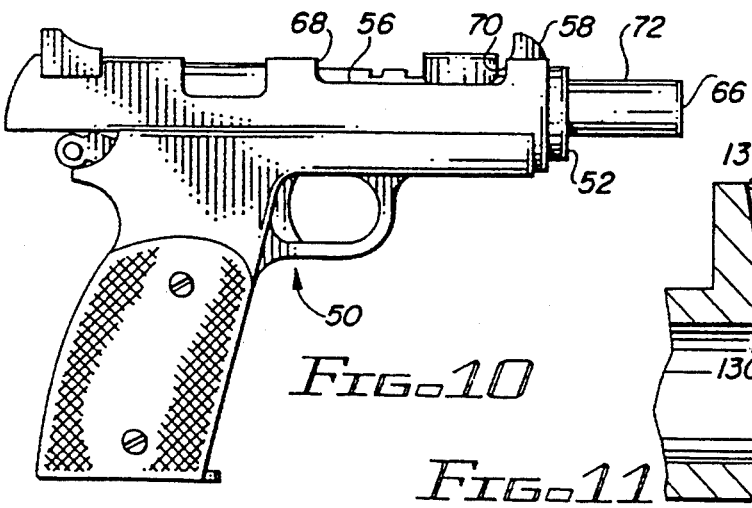
FIG. 10 is a side view of the pistol shown in FIG. 7 in the recoil position.

FIGS. 7–11 illustrate a semi-automatic pistol 50 incorporating the present invention and employing a continuous forward barrel bushing 52. The figures illustrate slide 54 in battery (FIGS. 7 and 8) and in the full recoil position (FIG. 10). Opening 56 in the top of the slide extends from forward of the locking lugs (not shown) to forward sight 58. First port 60 of the group of ports or nozzles (60,62) is closer to chamber 64 than to muzzle 66 of the firearm. In this case, port 60 is likely adjacent to the locking lugs and the remainder of the group of ports will be on the muzzle side of and close to the first port of the group of ports to permit slide 54 to move without interference during normal functioning of the gun. When the slide is in battery (FIGS. 7 and 8), ports 60,62 are located at the aft end of opening 56 in slide 54. When the slide is in the full recoil position (FIG. 10) the ports (60,62) are located at the forward end (70) of opening 56 in the slide. It should be noted that forward barrel bushing 52 completely surrounds barrel 72.

Figure 12:
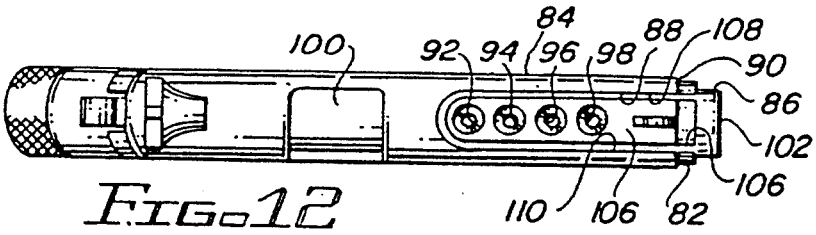
FIG. 12 is a top view of ported semi automatic pistol.
Figure 13:
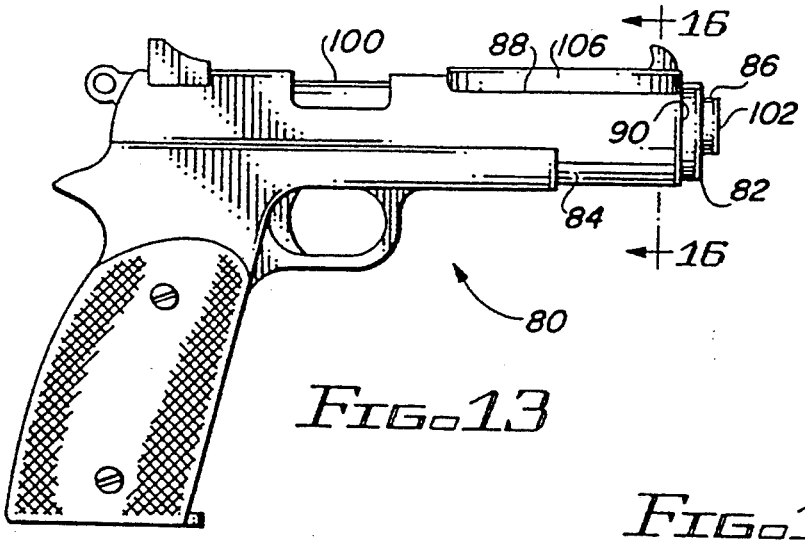
FIG. 13 is a side view of the pistol shown in FIG. 12.
Figure 14:
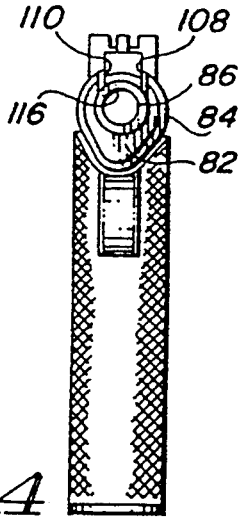
FIG. 14 is a front view of the pistol shown in FIG. 12.
Figure 15:
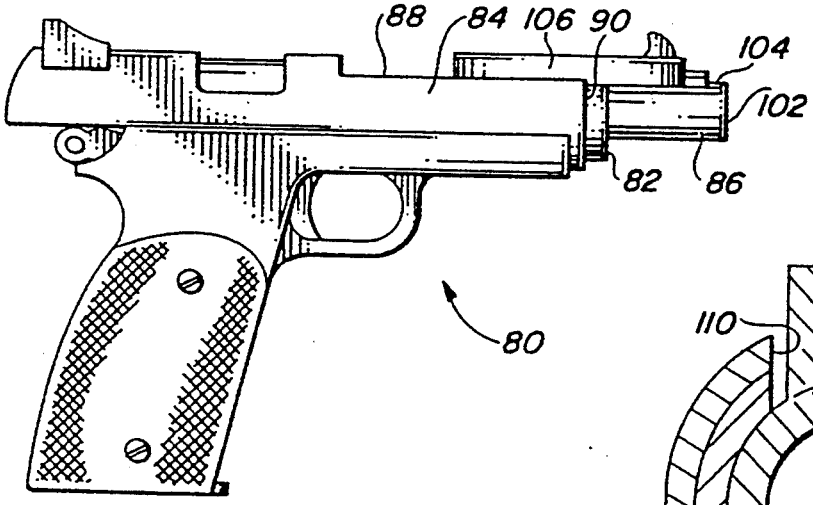
FIG. 15 is a side view of the pistol shown in FIG. 12 in the recoil position.
Figure 16:
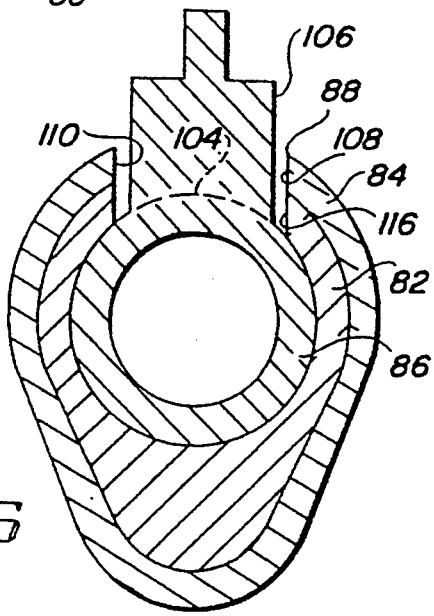
FIG. 16 is a cross sectional view taken along lines 16—16, as shown in FIG. 13.

FIGS. 12–16 illustrate a semi automatic pistol 80 incorporating the present invention and employing a slotted forward barrel bushing 82. FIG. 12 illustrates slide 84 in battery; FIG. 15 illustrates the slide in the full recoil position; and, FIG. 16 illustrates a cross section transverse to the axis of barrel 86 through the barrel bushing. Opening 88 in the top of slide 84 extends from forward of the locking lugs (not shown) to forward end 90 of the slide. First port 92 of the group of ports nozzles (92,94,96 and 98) is usually closer to chamber 100 than to muzzle 102 of the firearm and the remaining ports (94,96 and 98) are spaced along top 104 of barrel 86 between the first port of the group of ports and the muzzle. The group of ports is installed in the barrel and extended through an upper portion of the barrel called a rib 106; the rib extends from close to the locking lugs (not shown) forward to the muzzle end of slide 84. When the slide is in battery (FIGS. 12 and 13), the rib containing the ports 92,94,96 and 98 fills opening 88 in slide 84 and may extend a short distance above the slide. When the slide is in the full recoil position (FIG. 15) the opening has moved aft thereby making the upper surface of barrel 86 visible through the opening in the slide. It should be noted that the forward barrel bushing surrounds the barrel except where the forward barrel bushing is slotted to provide clearance for rib 106 to permit the barrel bushing to move along the barrel during normal cycling of the firearm. FIG. 16 illustrates a section transverse to the axis of the barrel and the slotted nature of the slide and the forward barrel bushing.

Of the many types of handheld firearms that could incorporate the present invention, semi automatic handgun 80 of the type illustrated in FIGS. 12–16 is well known and will be described in detail. This type of handgun is a .45 caliber semi automatic known as a United States government model 1911-A1. Only three pieces of the model 1911-A1 handgun need to be modified; the slide (84), the barrel (86) and the forward barrel bushing (82).

As shown in FIGS. 12–16, the slide of the model 1911-A1 handgun has been modified by cutting an opening 86 or slot into the upper forward surface of the slide. The slot would typically be 2.800 inches long and 0.400 inches wide with essentially vertical inner surfaces 108,110. Rear sight 112 would have to be raised about 0.250 inches to accommodate the positioning of front sight 114 upon rib 106, which sight may be 0.170 inches high. Barrel 86 has been modified by the installation of rib 106 which is typically 2,770 inches long by 0.375 inches wide by 0.350 inches high. The rib may but does not have to extend above the slide. While not visible in the figures, a small lateral slot is formed at the base of the rib near the forward end of the rib for the purpose of permitting certain manipulations of the forward barrel bushing during assembly of the model 1911-A1 handgun. Typically, there will be six ports (instead of four ports 92,94,96,98 shown in the figures) machined into the barrel/rib assembly. The axis of the first port is 0.190 inches from the aft end of rib 106 and the remaining five nozzles are spaced on 0.340 inch centers forwardly toward muzzle 102. The most forward port axis is 0.880 inches from the forward end of rib 106. The forward end of the rib is 0.130 inches from the muzzle so the most forward port is 1.010 inches from the muzzle.

Figure 11:
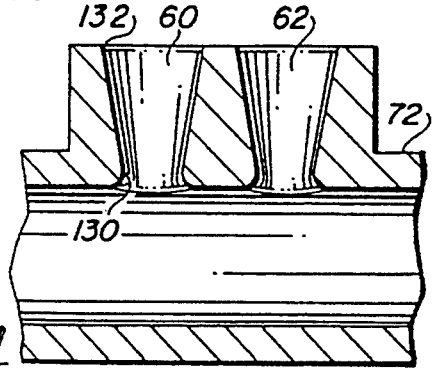
FIG. 11 is a partial cross sectional view taken along lines 11—11, as shown in FIG. 7.

Preferably the ports are nozzles of the type illustrated in FIGS. 3, 6 and 11. For a 0.452 caliber 1911-A1 handgun, each nozzle throat 130 is 0.187 inches inside diameter and the diameter of nozzle exit 132 is 0.310 inches. The nozzle expansion ratio is thus 2.75, giving a thrust coefficient of approximately 1.5 at the typical operating conditions for the model 1911-A1 handgun. Forward barrel bushing 82 is modified by cutting a vertical slot 116 0.400 inches wide and aligned with slot or opening 88 in slide 84 when the forward barrel bushing is installed in the slide.

To test the effectiveness of the barrel mounted nozzles, a gun supporting fixture was built. The fixture included a pivotally mounted "hand" element for supporting the gun and representative of a user's hand. Springs were employed to simulate the normal resilience of the wrist muscles in discouraging rotation of the hand. A further spring loaded pivotally mounted "arm" element supported the "hand" element to simulate the natural arm movement. Marking devices for recording vertical and pivotal movement of the "hand" element upon firing of the gun were incorporated. The tests were conducted with the model 1911-A1 handgun (.45 caliber) without a compensator, with several commercially available representative muzzle mounted "muzzle jump" compensators and with upwardly directed nozzles formed in the barrel in accordance with the above described nozzles. In all tests the same gun type and 200 grain projectiles with equally loaded cartridges were used. The data obtained by the markings produced at each firing were reduced mathematically to provide information on the amount of rise of the gun and the amount of rotation of the gun. For simplicity of comparison purposes, the data was normalized to the rise and rotation of an unmodified 1911-A1 handgun. This data appears in the following table:

TABLE

| Type of Compensation | Distance of Rise (%) | Degree of Rotation (%) | Energy of Rise (%) | Energy of (%) |
|---|---|---|---|---|
| UNCOMPENSATED | 100 | 100 | 100 | 100 |
| MORE OR LESS CONVENTIONAL MUZZLE MOUNTED MUZZLE JUMP COMPENSATORS | | | | |
| TYPE A | 73 | 82 | 53 | 66 |
| TYPE B | 79 | 76 | 63 | 58 |
| TYPE C | 78 | 83 | 61 | 68 |
| FORMED IN BARREL | 43 | 69 | 18 | 47 |

Reviewing these comparative figures, one can readily conclude that a conventional muzzle jump compensator produces a 23% decrease in the visually perceived gun rise and a 41% decrease in gun rise energy. The barrel with six nozzles produced a 57% decrease in the visually perceived gun rise and an 82% decrease in gun rise energy.

These figures clearly evidence an advance in the state of the art to reduce the gun rise and muzzle jump problems associated with shooting a handheld firearm quickly and accurately. Shooting performance, measured to test for both speed and accuracy and using firearms incorporating the upwardly directed nozzles, has shown very substantial speed and accuracy improvements over the performance possible using firearms incorporating any of the prior art ports or devices. These figures may even underestimate the ultimate shooting performance improvement possible to compensate for gun rise and muzzle jump.

Through further experiments it has been determined that the degree of gun rise compensation can be modified to avoid either over or under compensation by restricting or enlarging the diameter(s) of the nozzles close to the chamber. Moreover, the number of nozzles and their relative location anteriorly of the chamber can be optimized to suit particular caliber handguns and the amount and burn rate of the charge in the cartridges. Preferably, the center of thrust of the group of ports is believed to render best results if it is just forward of the center of gravity, as noted earlier. As a result of these experiments it has been determined that the use of four nozzles, as illustrated, and preferably six nozzles, provides an excellent compromise of cost, structural integrity, compensation for gun rise and compensation for muzzle jump. Moreover, an inlet nozzle diameter of 0.187 inches, an outlet nozzle diameter of 0.310 inches proving an expansion ratio of 2.75 and a thrust coefficient of approximately 1.5 has yielded excellent results; upon experimentation and further understanding of nozzles, different dimensions and parameters may be developed. As illustrated in the drawings, the nozzle inlet should be chamfered to aid in streamlining the gas flow into the nozzle and to reduce lead fouling.

As discussed above, gun rise and muzzle jump are two motions produced by a handgun when firing it. There is also the third motion resulting in lateral displacement and/or angular reorientation of the muzzle. Generally, the initial muzzle motion of a handgun fired by a right handed person using a two handed hold is up and to the right followed by clockwise circling motion during which the muzzle eventually moves across the target to a position below and to the left of the target. The clockwise circling motion results from the shooter attempting to compensate for the initial motion of the handgun. While the muzzle is crossing the target, the shooter will be tempted to yank on the trigger which can increase the lateral velocity of the handgun to the left. The usual result is a shot which misses the target low and left. Furthermore, the handgun is now moving more vigorously than it would have were the shooter to have waited for the handgun's motion to settle before firing the next shot. Some shooters, desiring a stiffer support for the handgun, will install a thumb rest for the weak hand thumb on the side of the handgun. For a right handed shooter, the thumb rest would be on the left side of the handgun. This thumb rest stiffens the handgun's support considerably. However, it makes the support even more asymmetric. The result is a handgun muzzle motion almost horizontally to the right instead of vertically upward.

The above problems caused by asymmetric support of the handgun can be compensated by designing the porting to generate asymmetric forces to counter and modify the resulting handgun motion to more closely approximate the desired (and controllable) vertical motion.

By rotating the thrust vectors of the nozzles a few degrees about the axis of the barrel, it is possible to generate both a vertical thrust to reduce gun rise and muzzle jump and a lateral thrust forwardly of the center of gravity of the handgun to compensate for the effects of lateral asymmetry of the handgun's support. Thereby, a close approximation of a controllable vertical muzzle motion is produced. In practice, canting the axis of the ports up to 30° left or right is easily achievable. Such canting can result in substantial lateral forces being applied to the handgun without a substantial reduction of the vertical forces necessary to counter gun rise and muzzle jump. For example, for a shooter using a thumb rest, as described above, canting the thrust vectors of the nozzle approximately 25° to the right will generate a substantial force to the left on the muzzle. This left oriented force compensates for the asymmetric support caused by the thumb rest on the left side of the handgun which otherwise would tend to produce a muzzle motion to the right. Thus, the combination of the thumb rest and the right canted ports results in a motion of the muzzle close to the desirable simple vertical muzzle motion. It may be noted that: 1) canting of the nozzles produces a considerable improvement in the direction of angular muzzle motion, and 2) canting of the ports in only one direction introduces a lateral force tending to move the handgun laterally. A new variable of lateral motion is therefore introduced.

A solution exists to minimize the new variable of lateral motion of the handgun to the left (in the example given above). By canting the ports closest to the muzzle to the right and canting the ports closest to the chamber to the left, several beneficial results are obtained. The net downward thrust of the nozzles will counter gun rise and muzzle jump. The forward most ports have a component of thrust to the left and the rear most ports have a component of thrust to the right to produce a counter clockwise force couple about the vertical axis of the handgun. This counter clockwise force couple will compensate for the tendency of angular orientation of the muzzle to the right. Because the component of total force to the left generated by the forward most ports is essentially counteracted by the component of force to the right generated by the rear most ports, the net lateral force acting upon the handgun and tending to result in lateral motion of the handgun is essentially eliminated.

The optimum port arrangement to produce the closest approximation to the desired simple vertical motion of the muzzle will be a function of the individual shooter's method of supporting the handgun. Moreover, not all shooting is done with a single method of supporting the handgun in that sometimes the handgun is held two handed, sometimes only by the strong hand and sometimes only by the weak hand. It is therefore clear that a given port arrangement will only be optimum for one shooter using one support method but the benefits of canting the ports to overcome lateral angular movement of the muzzle, lateral movement of the handgun and to reduce both gun rise and muzzle jump will be more effective than compensation which addresses only gun rise and muzzle jump.

Canting of the muzzles forward or rearward in the vertical plane or in a plane having a horizontal component may be useful for certain circumstances. Forward cant is useful for directing the plume of exhaust gases from the nozzles somewhat forwardly to exhaust the gases away from objects or people behind the nozzles. For instance, if an optical sighting device is located on top of the handgun behind the nozzles, forward expulsion of gases helps reduce deposition of propellant and bullet residue on the forward face of the optical sighting device. When the handgun is fired from the hip, with the handgun held relatively close to the body, forward canting of the nozzles will reduce the effect of nozzle discharge upon the shooter. The forward canting may increase the total recoil absorbed by the shooter because of the forward component of the gas discharge producing an aft directed thrust but the effect would be relatively minor. Rearward cant of the nozzles is useful where even a small reduction of recoil is desired by the shooter, such as in a very powerful handgun having significant recoil. Alternatively, the rearwardly canted nozzles could be used in a handgun to permit use of a more powerful cartridge without no increasing in recoil over that produced by a conventional cartridge in the same type handgun not having the rearwardly canted nozzles.

Figure 17:
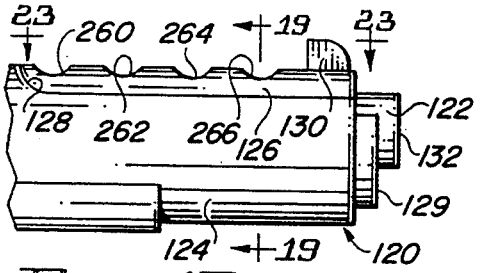
FIG. 17 is a partial illustration of the barrel of a semi automatic pistol.
Figure 18:
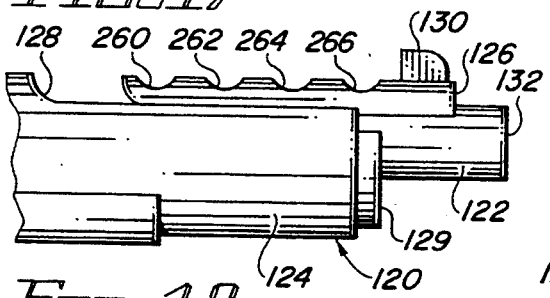
FIG. 18 illustrates the pistol shown in FIG. 17 in the recoil position.

Referring jointly to FIGS. 17 and 18, there is shown a semi automatic handgun, Such as model 1911-A1 , having a barrel 122 modified to provide ports in the form of nozzles having an upward and lateral component of thrust. FIG. 17 illustrates the handgun in the battery position and the handgun is shown in the recoil position in FIG. 18. Barrel 122 includes an upwardly extending rib 126 for housing the nozzles having an inlet commensurate with the bore of the barrel. Slide 124 includes a slot 128 dimensioned to slidably receive rib 126 without interference during translation of the slide from the battery position to the recoil position and return. A barrel bushing 129 includes a slot 116 (see FIG. 16) for accommodating rib 126. A front sight 130 may be located at or close to the muzzle 132 of the barrel. Typically, handgun 120 illustrated in FIG. 17 and 18 may be of the type shown in further detail in FIGS. 7–16.

Figure 19:
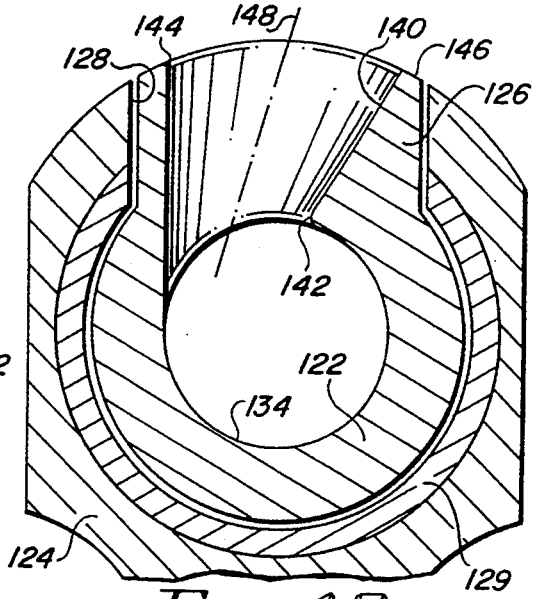
FIG. 19 is a cross-sectional view taken along lines 19—19, as shown in FIG. 17.

FIG. 19 illustrates rib 126 extending upwardly from barrel 122 and centered upon the vertical plane extending through the axis of bore 134. Barrel bushing 129 is commensurate with the barrel bushing shown in FIG. 16. A nozzle 140 includes an inlet 142 commensurate with bore 134 and an outlet 144 disposed in curved top surface 146 of rib 126. In order for nozzle 140 to have a lateral component of thrust, axis 148 of the nozzle is non coincident with a vertical plane extending through the axis of bore 134. The thrust generated by nozzle 140 will be centered along axis 148 and produce a downward force and a sideways or lateral force acting upon barrel 122. As stated above, it is preferable that inlet 142 be chamfered, as is well known in the relative dimensions of the inlet, the outlet and expansion ratio art of nozzles to increase the thrust produced. Moreover, the of the nozzle can be optimized by reference to appropriate literature. It may be noted that rib 126 has a height commensurate with the preferred nozzle length and configuration. Similarly, the configuration and the height of barrel bushing 129 and slot 128 formed therein are a function of the dimensions of rib 126.

Figure 20:
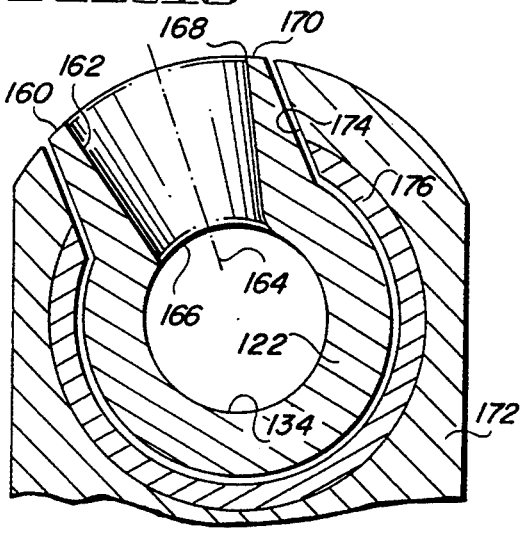
FIG. 20 is a cross-sectional view illustrating a variant of the port shown in FIG. 19 and FIG. **20*a* cross-sectional view illustrating a variant of the port shown in FIG. 20**.

Referring to FIG. 20, there is illustrated a first variant 160 of rib 126. Rib 160 extends from barrel 122 canted from the vertical plane of the barrel. Such canting permits forming a nozzle 162 in the rib, which nozzle has an axis 164 extending through the longitudinal axis of bore 134. This permits nozzle 162 to be symmetrical about axis 164 and to provide a horizontal and vertical component of thrust. Nozzle 162 includes an inlet 166 and an outlet 168 formed in top surface 170 of rib 160. Slide 172, a variant of slide 124, along with barrel bushing 176 are configured to accommodate canting of rib 160 and define slot 174 adjacent the rib.

Figure 20A:
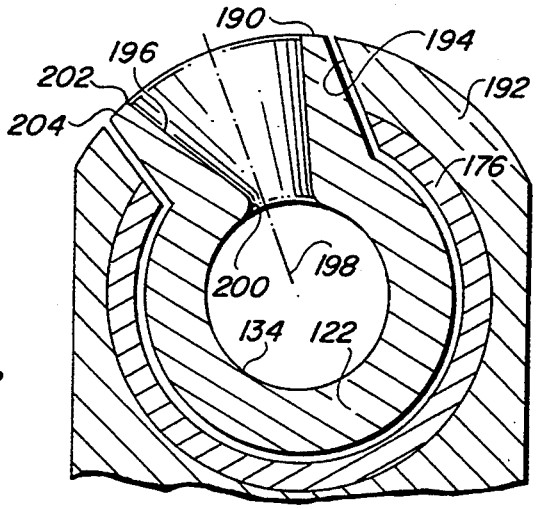

FIG. 20*a* illustrates a canted rib 190 extending from barrel 122. A slide 192 and a barrel bushing (not shown in FIG. 20*a*), which slide and barrel bushing may be the same as or very similar to slide 172 and barrel bushing 176, respectively, include a slot 194 for accommodating rib 190. Nozzle 196 is asymmetrical, like nozzle 140 shown in FIG. 19, and includes an axis 198 which does not pass through the axis of bore 134. An inlet 200 is coincident with the bore and an outlet 202 is formed in top surface 204 of rib 190.

Figure 21:
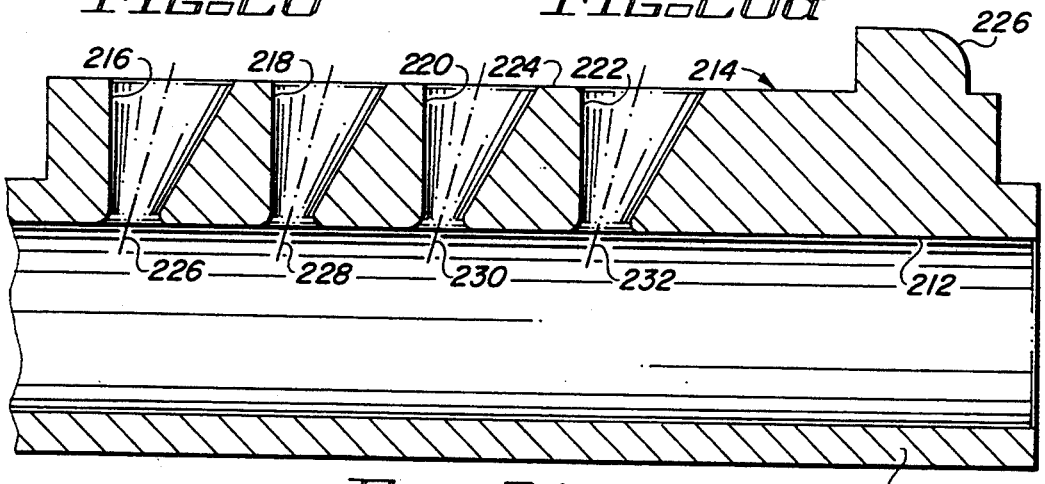
FIG. 21 is a partial cross-sectional view illustrating forwardly angled ports in the rib of a barrel.

FIG. 21 illustrates a barrel 210 having a bore 212 and an upwardly extending rib 214. A plurality of nozzles, such as nozzles 216, 218, 220 and 222 include an inlet commensurate with bore 212 and an outlet disposed in top surface 224 of rib 214. A front sight 226 may be disposed at the front end of the rib. As illustrated, nozzles 216, 218, 220 and 222 include forwardly tilted axis 226, 228, 230 and 232 whereby each of the nozzles provides a forwardly oriented component of thrust resulting in a rearwardly oriented force acting upon barrel 210. The forward orientation of the axis of these nozzles may be combined with a lateral orientation, whether right of left, to provide a lateral component of thrust and resulting lateral force acting upon the barrel. As shown in FIG. 22, barrel 230 includes a rib 232 having a plurality of nozzles 234, 236, 238 and 240 extending from bore 242 through the rib to top surface 244. Axis 246, 248, 250 and 252 of nozzles 234, 236, 238, 240, respectively, are rearwardly oriented. These axes may also include a lateral or off vertical orientation to establish a lateral component of thrust and commensurate lateral component of force exerted upon barrel 230. A front sight 254 may extend upwardly from top surface 244.

FIG. 23 illustrates a top view of barrel 122 shown in side view in FIG. 17. Rib 126 includes four nozzles, 260, 262, 264 and 266 of the type shown in FIG. 19. Rib 126 is essentially centered upon a vertical plane extending through the axis of the bore of barrel 122. Nozzles 260 and 262 provide a Component of thrust upwardly vertically and horizontally to the left. The lateral thrust of these two nozzles provide a force, represented by arrow 270, acting upon barrel 122 to the right. Nozzles 264 and 266 provide a component of thrust vertically upwardly and horizontally to the right. The horizontal components of thrust of these two nozzles provide a force acting upon the barrel to the left, as depicted by arrow 272. The resulting effect of these two forces produces a force couple about a vertical axis disposed between nozzles 262 and 264 and passing through or close to the axis of the bore of barrel 122. Because the opposed horizontal components of thrust essentially cancel one another, net lateral movement of the barrel will not be induced. However, the force couple produced will tend to Urge a counter clockwise rotation of the barrel. Thus, compensation for the horizontal angular movement of the handgun to the right and resulting from the asymmetric hand support of the handgun will be essentially compensated, as discussed above. Because of the vertical component of thrust produced by the combination of nozzles 260, 262, 264 and 266, gun rise and muzzle jump will be reduced. The net effect will be that of maintaining movement of the handgun upon firing to an essentially relatively simple limited upward movement in the vertical axis which movement can be compensated by a skilled shooter.

FIG. 24 illustrates a barrel 122 having a slide 124 and a barrel bushing 129 with a slot 128 to accommodate rib 126. The rib is similar to that illustrated in FIGS. 18 and 19. Nozzles 280, 282, 284 and 286 may be asymmetric and of the type shown in FIG. 19. The axis of each of these nozzles includes a vertical component extending upwardly and a lateral component extending to the right. The horizontal component of thrust generated by nozzles 280, 282 will produce a force acting upon the barrel to the left, as depicted by arrow 288. Similarly, the horizontal component of thrust generated by nozzles 284, 286 will produce a force acting on the barrel to the left, as depicted by arrow 290. The resulting forces acting upon the barrel will tend to rotate the barrel horizontally to the left and also displace the handgun to the left. Depending upon the manner of the hand hold of the shooter, these forces may be equivalent to and compensate for the asymmetric hand support of the shooter.

FIG. 25 illustrates a barrel 122 having a rib 126 disposed within slot 128 of slide 124 and barrel bushing 129. The configuration of the rib is similar to that illustrated in FIG. 19. Furthermore, nozzles 234, 236, 238 and 240 are oriented similarly to the equivalent nozzles illustrated in cross section in FIG. 22. These nozzles will produce a component of upward vertical thrust to counter gun rise and muzzle jump. Furthermore, these nozzles will have a rearwardly oriented thrust that produces a forwardly acting force, as depicted by arrow 294.

FIG. 26 illustrates a barrel 122 having a rib 126 disposed within slot 128 of slide 124 and barrel bushing 129. The rib includes a plurality of upwardly and forwardly oriented nozzles 216, 218, 220 and 222 of the type illustrated in cross section in FIG. 21. These nozzles provide a vertical component of thrust to counter gun rise and muzzle jump. Furthermore, the nozzles provide a forward component of thrust to produce a rearwardly acting force upon the barrel, as depicted by arrow 298.

From the above discussion of FIGS. 21–26, nozzles having vertical components of thrust in combination with horizontal components of thrust, whether left, right, forwardly or rearwardly have been described. As reviewed above, the vertical component of thrust is used primarily to counter gun rise and muzzle jump. The lateral components of thrust, particularly left and/or right components of thrust are established to compensate for the asymmetric forces resulting from the manner in which a hand gun is held. The forward and/or rearward components of thrust are used primarily where control of the direction of the gases expelled is of primary importance and a commensurate increase or decrease in recoil is usually of secondary importance. It is to be understood that any given barrel may have one or more nozzles oriented to provide a horizontal component of thrust to the left, to the right, forwardly or rearwardly depending upon the type and nature of lateral motion of the handgun to be accommodated and compensated.

FIG. 27 illustrates a barrel 122 having a canted rib 160 of the type shown in FIGS. 20 or 20*a* and disposed within a slot 174 of a sleeve 172 and a barrel bushing 176. Nozzles 300, 302, 304 and 306 may be of the type illustrated in FIGS. 20 or 20*a*. Each of these nozzles includes an upward vertical component of thrust to counter gun rise and muzzle jump. Each of these nozzles also includes a horizontal component of thrust directed to the right. Such thrust will produce forces acting upon barrel 122 to the left, as depicted by arrows 308 and 400. By canting rib 160, angular rotation of the axis of the nozzles illustrated in FIG. 27 may be greater than that possible from the vertically centered rib, as shown in FIG. 19. Accordingly, by canting the rib and using either symmetric nozzles, as depicted in FIG. 20, or asymmetric canted nozzles, as illustrated in FIG. 20*a*, more substantial components of thrust in the horizontal axis may be available resulting in commensurate increase in the horizontally oriented force(s) acting upon the barrel.

Referring to FIG. 28, there is shown a barrel 122 having a canted rib 160 of the type illustrated in FIGS. 20 and 20*a* and disposed within slot 174 of slide 172 and barrel bushing 176. Nozzles 410 and 412 provide a vertical component of thrust to counter gun rise and muzzle jump. Additionally, these nozzles provide a horizontal component of thrust to the left to produce a force acting to the right upon barrel 122, as depicted by arrow 418. Nozzles 414 and 416 include an upward vertical component of thrust to counter gun rise and muzzle jump. Additionally, they provide a horizontal component of thrust to the right to generate a force acting to the left upon barrel 122, as depicted by arrow 420. The forces depicted by arrows 418, 420 are essentially equal and in opposite directions and will not tend to urge barrel 122 either left or right. However, the two forces produce a force couple about a canted axis extending through the barrel and disposed between nozzles 412 and 414 to urge a pivotal movement of the muzzle to the left. Such pivotal movement is intended to and does compensate for the asymmetric forces attendant the handheld support for the handgun, as discussed in further detail above. Thereby, nozzles 410, 412,414 and 416 compensate not only for gun rise and muzzle jump but also for the asymmetric forces resulting from the manner in which a handgun is held.

Referring to FIG. 29, there is illustrated a barrel 122 having a canted rib 160 of the type illustrated in FIGS. 20 or 20*a* disposed within slot 174 of slide 172 and barrel bushing 176. Nozzles 424, 426, 428 and 430, which may be of the symmetric type illustrated in FIG. 20 or the asymmetric type illustrated in FIG. 20*a*, have their axis oriented upwardly forwardly to the right. The vertical component of thrust produced will counter gun rise and muzzle jump. The horizontal component of thrust will produce forces, as depicted by arrows 432, 434 acting rearwardly and to the left. The left oriented horizontal components of force will tend to counteract the asymmetric forces resulting from the hand held support of the handgun. The forward horizontal component of thrust will orient the plume of exhaust gases away from the shooter.

FIGS. 24 and 27 depict the nozzles having a horizontal component of thrust to the right to produce a component of force to the left. These nozzles can similarly be oriented to provide a horizontal component of thrust to the left with the resulting forces acting to the right. Such choice of nozzle orientation in horizontal axis would be a function of the manner and nature of hand held support for the handgun. The counter clockwise force couple produced from the orientation of nozzles depicted in FIGS. 23 and 28 could be reversed by simply reorienting the lateral orientation of the pairs of nozzles. Moreover, one or more of these nozzles could be oriented to provide a horizontal component of thrust either forwardly or rearwardly. The orientation of the nozzles depicted in FIG. 29 could be altered to provide a horizontal component of thrust forwardly and to the left or rearwardly to either the right or the left. Furthermore, fewer than all of the nozzles could be oriented to provide a horizontal component of thrust forwardly or rearwardly or the right or the left. It is therefore evident that the orientation of the nozzles in the uncanted or canted rib can be readily selected as a function of the asymmetry of the hand held support for the handgun.

While the nozzles depicted in FIG. 17–29 have been depicted primarily with reference to a model 1911-A1 semi automatic pistol, nozzles of any of the types shown with any of the orientations depicted in FIGS. 17–29 could be incorporated in other types of pistols or revolvers by simply adding an appropriately configured rib and forming the nozzles therein in communication with the bore of the barrel. Rifles and shotguns generally do not have the same problems of asymmetric support as handguns, horizontal components of force could be created by commensurate orientation of the nozzles to compensate for any asymmetry in support of the rifle or shotgun.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for reducing gun rise, muzzle jump and laterally oriented movement of a semi automatic pistol upon discharge of the pistol, the pistol including a chamber, barrel having a bore formed therein defining a longitudinal axis of rotation and extending from the chamber and a muzzle defining an outlet end of the bore, a slide translatable along the barrel between a battery position and a recoil position during each discharge cycle of the pistol and a barrel housing for supporting the barrel, said apparatus comprising in combination:

a) a rib extending from the barrel, said rib including a surface;

b) a plurality of nozzles extending through said rib for discharging a portion of the exhaust gases present within the bore of the barrel upon discharge of the pistol to provide a force acting on the pistol in response to the thrust generated during discharge, each nozzle of said plurality of nozzles including an inlet disposed at the bore, an outlet disposed in said surface of said rib and a laterally oriented axis extending through said inlet and said outlet, each of said nozzles providing thrust along said laterally oriented axis and a commensurate force acting upon the pistol, at least one of said plurality of nozzles producing a force, which force has a vertical component of force to counter gun rise and muzzle jump and a horizontal component of force to produce laterally oriented movement of the pistol; and c) a slot disposed in each of the slide and the barrel housing for receiving said rib and for accommodating movement of said slide between the battery position and the recoil position.

2. The apparatus as set forth in claim 1 wherein at least two of said plurality of nozzles provide opposed horizontal components of force to produce a force couple to counter any tendency of angular displacement of the barrel in the horizontal plane and without inducing lateral displacement of the pistol in the horizontal plane.

3. The apparatus as set forth in claim 2 wherein at least another of said plurality of nozzles provides a horizontal component of force to produce lateral displacement of the pistol upon discharge.

4. The apparatus as set forth in claim 1 wherein said plurality of nozzles are aligned along the barrel.

5. The apparatus as set forth in claim 1 wherein the laterally oriented axis of at least one nozzle of said plurality of nozzles intersects the longitudinal axis of the bore.

6. The apparatus as set forth in claim 1 wherein the laterally extending axis of at least one nozzle of said plurality of nozzles does not intersect the longitudinal axis of the bore.

7. Apparatus for reducing gun rise, muzzle jump and lateral reorientation upon discharge of a semi automatic pistol having a chamber, a barrel having a bore extending from the chamber to a muzzle defining an outlet end of the bore, a slide translatable along the barrel between a battery position and a recoil position during each discharge cycle of the pistol, said apparatus comprising in combination:

a) at least one upwardly directed nozzle disposed in the barrel for exhausting exhaust gas therethrough from the bore upon discharge of the pistol to develop a component of a downwardly directed force on the pistol to counter gun rise and muzzle jump of the pistol upon discharge, said at least one nozzle being disposed in the barrel at a location closer to the muzzle than to the chamber;

b) at least one further nozzle disposed in the barrel for exhausting exhaust gas therethrough from the bore upon discharge of the pistol to develop a component of a downwardly directed force on the pistol to counter gun rise and muzzle jump of the pistol upon discharge, said at least one further nozzle being disposed in the barrel and located toward the muzzle from said at least one nozzle, at least one of said at least one nozzle and said at least one further nozzle being angled laterally to develop a component of a laterally directed force on the pistol to counter lateral reorientation of the pistol upon discharge; and c) an opening disposed in the slide for maintaining said at least one nozzle and said at least one further nozzle exposed during translation of the slide between the battery position and the recoil position.

8. Apparatus for reducing gun rise, muzzle jump and lateral reorientation of a semi automatic pistol upon discharge, the pistol having a chamber, a barrel having a bore extending from the chamber to a muzzle defining an outlet end of the bore, a slide reciprocally translatable along the barrel between a battery position and a recoil position during each discharge cycle of the pistol, said apparatus comprising in combination:

a) a rib extending upwardly from the barrel;

b) at least one upwardly directed nozzle extending through said rib and the barrel for exhausting exhaust gas therethrough from the bore upon discharge of the pistol to develop a component of a downwardly directed force on the pistol to counter gun rise and muzzle jump of the pistol upon discharge, said at least one nozzle being disposed in the barrel at a location closer to the muzzle than to the chamber;

c) at least one further nozzle extending through said rib and the barrel for exhausting exhaust gas therethrough from the bore upon discharge of the pistol to develop a component of a downwardly directed force on the pistol to counter gun rise and muzzle jump of the pistol upon discharge, said at least one further nozzle being disposed in the barrel and located along the barrel toward the muzzle from said at least one nozzle, at least one of said at least one nozzle and said at least one further nozzle being angled laterally to develop a component of a laterally directed force on the pistol to counter lateral reorientation of the pistol upon discharge; and d) an opening disposed in the slide for maintaining said at least one nozzle and said at least one further nozzle exposed during translation of the slide between the battery position and the recoil position.

9. A method for reducing gun rise, muzzle jump and lateral reorientation of a semi automatic pistol upon discharge, the pistol having a translatable slide translatable between a battery position and a recoil position upon discharge of the pistol to fire a projectile, which pistol includes a chamber, a barrel having a bore and a muzzle at the anterior end of the barrel, said method comprising the steps of:

a) venting exhaust gas during discharge of the pistol upwardly from the bore and through at least one port located along the barrel between the chamber and the muzzle to counter gun rise and muzzle jump;

b) discharging exhaust gas during discharge of the pistol upwardly from the bore and through at least a further port located toward the muzzle from the port closest to the chamber to counter gun rise and muzzle jump;

c) expelling exhaust gas during discharge of the pistol from the bore and through at least one of the one port and the further port to develop a force having at least a lateral component to counter lateral reorientation; and d) maintaining the ports exposed through an opening in the slide during translation of the slide.

10. The method as set forth in claim 9 including the step of exhausting exhaust gas from at least one of the one port and the further port to develop a force having at least a lateral component of force essentially equal and opposite to the lateral component of force resulting from said step of expelling to develop a force couple to produce angular reorientation of the pistol upon discharge.

11. Apparatus for reducing gun rise, muzzle jump and lateral reorientation of a semi automatic pistol upon discharge, the pistol having a chamber, a barrel having a bore extending from the chamber to a muzzle defining an outlet end of the bore, a slide translatable along the barrel between a battery position and a recoil position during each discharge cycle of the pistol, said apparatus comprising in combination:

a) at least one upwardly directed nozzle disposed in the barrel for exhausting exhaust gas therethrough from the bore upon discharge of the pistol to develop a component of downwardly directed force on the pistol to counter gun rise and muzzle jump of the pistol and to develop a component of laterally directed force on the pistol to counter lateral reorientation of the pistol, one nozzle of said at least one nozzle being located along the barrel at a location closer to the muzzle than to the chamber; and b) a slot disposed in the slide for maintaining said at least one nozzle exposed during translation of the slide between the battery position and the recoil position.

12. The apparatus as set forth in claim 11 wherein said at least one nozzle comprises at least two nozzles and wherein the components of laterally directed force on the pistol developed by at least said two nozzles are in opposed directions to create a force couple acting upon the pistol to produce angular reorientation of the pistol.

13. Apparatus for reducing gun rise, muzzle jump and lateral reorientation of a semi automatic pistol upon discharge, the pistol having a chamber, a barrel having a bore extending from the chamber to a muzzle defining an outlet end of the bore, a slide translatable along the barrel between a battery position and a recoil position during each discharge cycle of the pistol, said apparatus comprising in combination:

a) a rib extending upwardly from the barrel;

b) at least one upwardly directed nozzle extending through said rib and the barrel for exhausting exhaust gas therethrough from the bore upon discharge of the pistol to develop a component of downwardly directed force on the pistol to counter gun rise and muzzle jump of the pistol and to develop a component of laterally directed force on the pistol to counter lateral reorientation of the pistol, said at least one nozzle being located along the barrel closer to the chamber than to the muzzle; and c) a slot disposed in the slide for maintaining said at least one nozzle exposed during translation of the slide between the battery position and the recoil position.

14. The apparatus as set forth in claim 13 wherein said at least one further nozzle comprises at least two nozzles and wherein the components of laterally directed force on the pistol developed by said at least two nozzles are in opposed directions to create a force couple acting upon the pistol to produce angular reorientation of the pistol.

15. A method for reducing gun rise, muzzle jump and lateral reorientation of a semi automatic pistol upon discharge, the pistol having a slide translatable between a battery position and a recoil position upon discharge of the pistol to fire a projectile, which pistol includes a chamber, a barrel having a bore and a muzzle at the anterior end of the bore, a rib extending along the barrel and a plurality of ports extending through and located along the barrel, at least some ports of the plurality of ports also extending through the rib, said method comprising the steps of:

(a) venting exhaust gas during discharge of the pistol through at least one port of the plurality of ports to create a component of force acting downwardly upon the pistol to reduce gun rise and muzzle jump;

(b) expelling exhaust gas during discharge of the pistol from at least another port of the plurality of ports to create a component of force acting laterally upon the pistol to counter lateral reorientation of the pistol upon discharge;

(c) maintaining each port of the plurality of ports exposed during translation of the slide; and (d) at least one of said steps of venting and expelling being carried out through those ports of the plurality of ports extending through the rib and through the barrel to the bore.

16. The method as set forth in claim 15 wherein said steps of venting and expelling are carried out through the same ports.

17. Apparatus for reducing gun rise and muzzle jump upon discharge of a semi automatic pistol having a chamber, a barrel having a bore defining an axis of rotation and extending from the chamber to a muzzle defining an outlet end of the bore, a slide translatable along the barrel between a battery position and a recoil position during each discharge cycle of the pistol, said apparatus comprising in combination:

a) at least one upwardly directed nozzle having an axis disposed in the barrel for exhausting exhaust gas therethrough from the bore along the nozzle axis upon discharge of the pistol to develop a component of a downwardly directed force on the pistol to counter gun rise and muzzle jump of the pistol upon discharge, said at least one nozzle being disposed in the barrel at a location closer to the muzzle than to the chamber;

b) at least one further nozzle having a nozzle axis disposed in the barrel for exhausting exhaust gas therethrough from the bore along the further nozzle axis upon discharge of the pistol to develop a component of a downwardly directed force on the pistol to counter gun rise and muzzle jump of the pistol upon discharge, said at least one further nozzle being disposed in the barrel and located toward the muzzle from said at least one nozzle;

c) each of said nozzle axis and said further nozzle axis being in a non perpendicular relationship with the axis of rotation; and d) an opening disposed in the slide for maintaining said at least one nozzle and said at least one further nozzle exposed during translation of the slide between the battery position and the recoil position.

18. The apparatus as set forth in claim 17 wherein said nozzle axis and said further nozzle axis cant toward the muzzle to develop a component of force rearwardly on the pistol.

19. The apparatus as set forth in claim 18 wherein said nozzle axis and said further nozzle axis lie in a vertical plane extending through and including the axis of rotation of the bore.

20. The apparatus as set forth in claim 17 wherein said nozzle axis and said further nozzle axis cant toward the chamber to develop a component of force forwardly on the pistol.

21. The apparatus as set forth in claim 20 wherein said nozzle axis and said further nozzle axis lie in a vertical plane extending through and including the axis of rotation of the bore.

22. Apparatus for reducing gun rise and muzzle jump of a semi automatic pistol upon discharge of the pistol, the pistol including a chamber, a barrel having a bore formed therein defining an axis of rotation and extending from the chamber, a vertical plane extending through this axis of rotation with the axis of rotation lying therein, a muzzle defining an outlet end of the bore, a slide transferable along the barrel between a battery position and a recoil position during each discharge cycle of the pistol and a barrel housing for supporting the barrel, said apparatus comprising in combination:

a) a rib extending from the barrel and centered upon the vertical plane, said rib including a surface;

b) a plurality of nozzles extending through said rib for discharging a portion of the exhaust gases present within the bore of the barrel upon discharge of the pistol to provide a force acting on the pistol in response to the thrust generated during discharge, each nozzle of said plurality of nozzles including an inlet disposed at the bore, an outlet disposed in said surface of said rib and a nozzle axis extending through said inlet and said outlet, each of the nozzle axes being non perpendicular to the axis of rotation, each of said nozzles providing thrust along the respective nozzle axis and a commensurate force acting upon the pistol; and c) a slot disposed in each of the slide and barrel housing for receiving said rib and for accommodating movement of said slide between the battery position and the recoil position.

23. The apparatus as set forth in claim 22 wherein at least one of said plurality of nozzles provide a component of force toward the muzzle.

24. The apparatus as set forth in claim 22 wherein at least one of said plurality of nozzles provide a component of force toward the chamber.

25. A method for reducing gun rise and muzzle jump of a semi automatic pistol upon discharge, the pistol having a translatable slide translatable between a battery position and a recoil position upon discharge of the pistol to fire a projectile, said pistol including a chamber, a barrel having a bore defining an axis of rotation, a muzzle at the anterior end of the barrel and a vertical plane extending through the axis of rotation with the axis of rotation lying therein, said method comprising the steps of:

a) venting exhaust gas during discharge of the pistol upwardly from the bore and through at least one port located along the barrel between the chamber and the muzzle to counter gun rise and muzzle jump;

b) discharging exhaust gas during discharge of the pistol upwardly from the bore and through at least a further port located toward the muzzle from the at least one port to counter gun rise and muzzle jump;

c) expelling exhaust gas during discharge of the pistol from the bore and through the at least one and at least a further ports along individual port axis, which port axes are not perpendicular to the axis of rotation; and d) maintaining the ports exposed through an opening in the slide during translation of the slide.

26. The apparatus as set forth in claim 25 wherein the port axes cant toward the muzzle and said step of expelling expels the exhaust gas in the direction of the muzzle.

27. The apparatus as set forth in claim 26 wherein the port axes are located in a vertical plane containing the axis of rotation.

28. The apparatus as set forth in claim 25 wherein the port axes cant toward the chamber and said step of expelling expels the exhaust gas in the direction of the chamber.

29. The apparatus as set forth in claim 28 wherein the port axes are located in a vertical plane containing the axis of rotation.

* * * * *